US005101104A

United States Patent [19]

Schroeder

[11] Patent Number: 5,101,104

[45] Date of Patent: Mar. 31, 1992

[54] CARRIER APPARATUS FOR RADIOACTIVE WELL LOGGING INSTRUMENT

[75] Inventor: Derryl G. Schroeder, Houston, Tex.

[73] Assignee: Western Atlas International, Inc., Houston, Tex.

[21] Appl. No.: 590,468

[22] Filed: Sep. 27, 1990

[51] Int. Cl.[5] ..... G01V 5/04

[52] U.S. Cl. ..... 250/268

[58] Field of Search ..... 250/268, 256

[56] References Cited

U.S. PATENT DOCUMENTS

| | | | |
|---|---|---|---|
| 3,654,470 | 4/1972 | Wilson | 250/268 |
| 3,978,939 | 9/1976 | Trouiller | 250/268 |
| 4,445,032 | 4/1984 | Halker et al. | 250/256 |
| 4,588,951 | 5/1986 | Ohmer | 250/268 |

*Primary Examiner*—Carolyn E. Fields
*Assistant Examiner*—James E. Beyer
*Attorney, Agent, or Firm*—Darryl M. Springs

[57] ABSTRACT

A carrier apparatus for a radioactive well logging instrument is disclosed that includes an elongated generally cylindrical tool body adapted for wireline suspension within a well borehole and mounting an elongated sensor pad assembly carrying a radioactive source and at least one detector and adapted for a nesting fit with the tool body. Knuckle joint links mounted on the tool body engage opposite ends of the sensor pad for laterally extending the pad assembly from the tool body into contact with the borehole wall. The knuckle joint links provide independent preselected force loading to each end of the pad assembly and permit articulation of the pad assembly with respect to the tool body axis for maintaining the sensor pad assembly in contact with the borehole wall under rugose conditions. In addition, a pair of decentralizing arms are mounted on the tool body on the side opposite the side carrying the sensor pad assembly for contacting the borehole wall and decentering the longitudinal axis of the tool body in the borehole in the direction of extension of the sensor pad assembly. A pair of spring assemblies are disposed in the tool body and cooperate with each of the decentralizing arms for providing independent preselected force loading to each of the arms and applying a predetermined decentralizing force load to the borehole wall. The knuckle joint links, the decentralizing arms and the spring asemblies are actuated by motors mounted on the carrier and applying loading forces to the decentralizing arms.

3 Claims, 6 Drawing Sheets

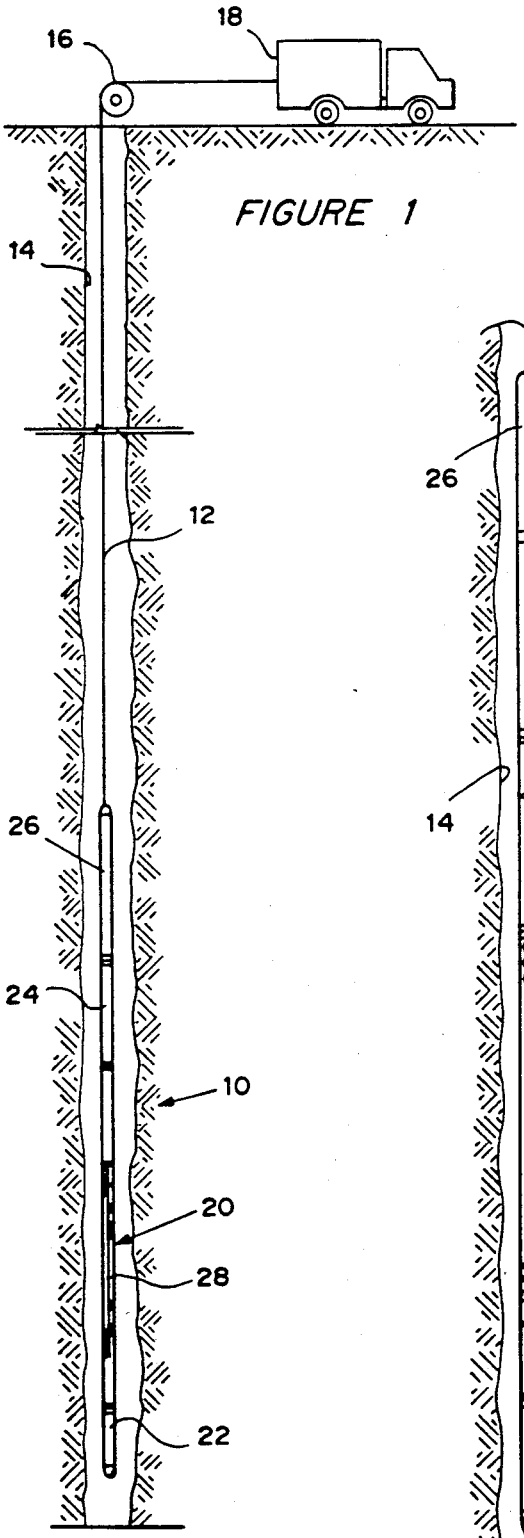
FIGURE 1
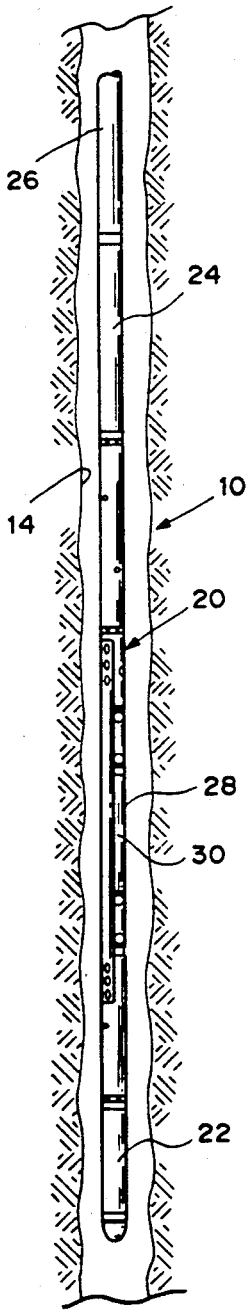
FIGURE 2
FIGURE 3
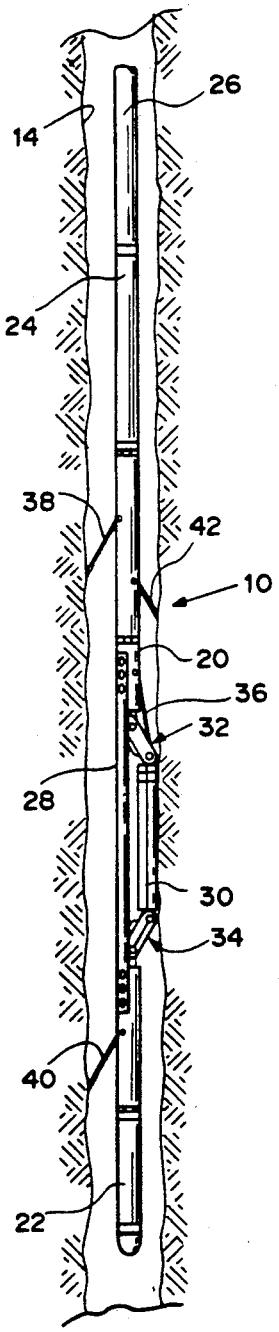

FIGURE 13
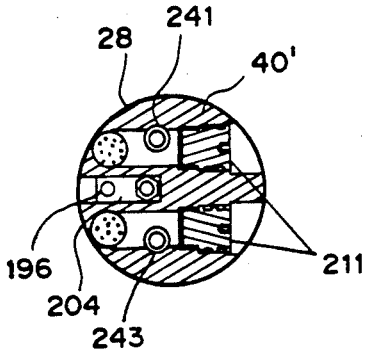
FIGURE 14
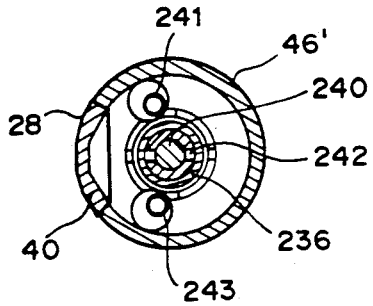
FIGURE 15
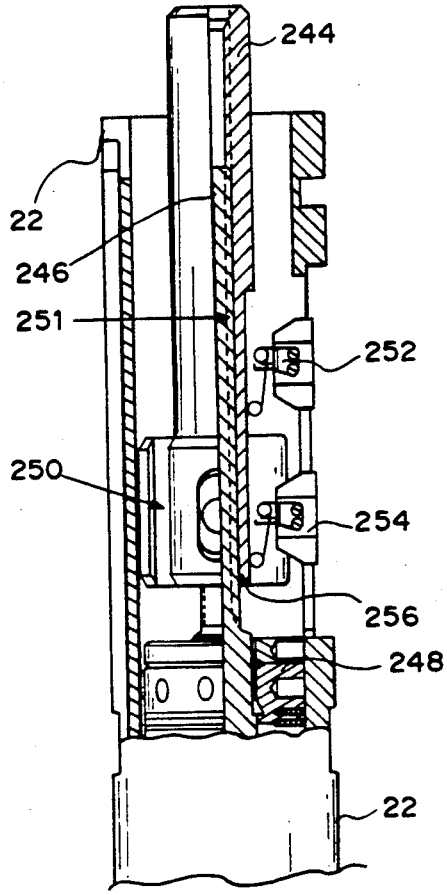
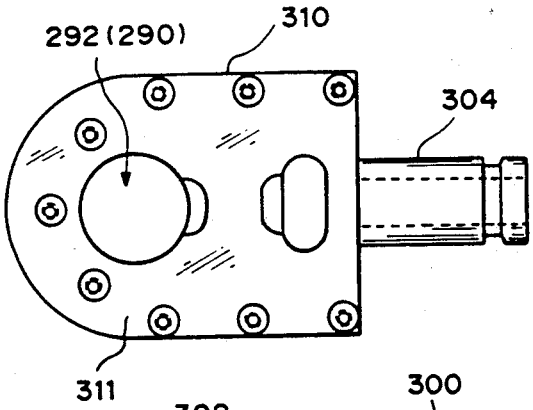
FIGURE 21
FIGURE 22
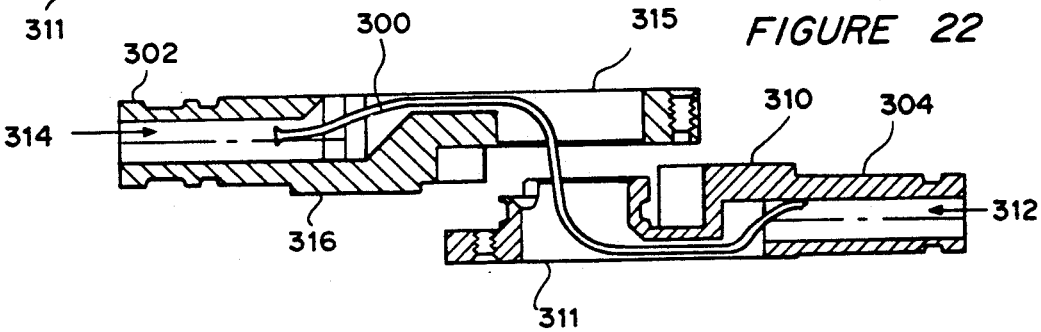

CARRIER APPARATUS FOR RADIOACTIVE WELL LOGGING INSTRUMENT

BACKGROUND OF THE INVENTION

The present invention relates to radioactive logging well logging tools and more particularly to carrier apparatus for transporting and deploying a radioactive sensor package into a well borehole for logging purposes.

In obtaining certain radioactive logging data from the formation surrounding an oil or gas well borehole, it is necessary to maintain the radioactive source in contact with the borehole wall to prevent scattering of the radioactive energy into the borehole annulus instead of the formation. This is especially true in making gamma ray radiation measurements of the formation to determine bulk density and photoelectric absorption index in which a sensor package is used that includes a gamma ray source and a pair of spaced scintillation detectors to measure the scattering and absorption effects of the formation on the gamma ray energy entitled by the source. Quality measurements for this type of logging instrument requires that the sensor package maintain constant contact with the borehole wall during the logging trip up the borehole. If the borehole wall has an extremely rugose condition, the sensor pad or package may tend to lift off from the wall and lose direct contact with the borehole wall. If the sensor pad or package loses contact with the formation comprising the borehole wall, some of the gamma ray energy will be diverted into the borehole annulus instead of the formation, resulting in less accurate measurements with a high degree of uncertainty. In addition, many existing radioactive logging tools cannot traverse small diameter boreholes (to a minimum of 4.5 inches) because of the tool carrier diameter dictated by the operation of and the sensor pad package and the arm extension means for extending the sensor package into contact with the borehole wall.

Yet another feature of the present invention is to provide carrier apparatus for a radioactive logging sensor pad that includes decentralizing arms extendable into contact with the borehole wall for decentering the axis of the tool in the direction of extension of the sensor pad assembly having force loading applied to the decentralizing arms for maintaining constant contact between the borehole wall and the decentralizing arms to accommodate known borehole diameters.

Accordingly, one feature of the present invention is to provide carrier apparatus for a radioactive sensor package having linkage means that may be actuated to extend the sensor pad laterally into contact with the borehole wall, the linkage means providing preselected force loading for linkages interconnecting the ends of the sensor pad to the tool body for providing articulated movement of the sensor pad with respect to the axis of the tool body in order for the sensor pad to maintain constant contact with the borehole wall under rugose conditions.

Another feature of the present invention is to provide a rugosity caliper for measuring the rugosity of the borehole wall along the longitudinal path to be traversed by the sensor pad or package.

Still another feature of the present invention is to provide a tool body or carrier for a radioactive sensor pad assembly that when in its actuated condition can traverse boreholes with diameters below 5 inches.

SUMMARY OF THE INVENTION

In accordance with the principles of the present invention, a carrier apparatus for a well logging instrument is provided that includes an elongated generally cylindrical tool body that is adapted for entry, suspension and movement within an oil and gas well borehole that includes an elongated sensor pad assembly carrying a radioactive source and radioactive energy detector, with the sensor pad assembly adapted for a nesting fit within said tool body.

Linkage means mounted on the tool body engages opposite ends of the elongated sensor pad assembly for laterally extending the pad assembly from said tool body into contact with the borehole wall. The linkage means comprises a knuckle joint linkage system attached to each end of the sensor pad assembly for deploying the sensor pad assembly. Each knuckle joint link also provides independent adjustable force loading to each end of the pad assembly for permitting articulation of the pad assembly with regard to the tool body axis for maintaining the sensor pad assembly in contact with the borehole wall under rugose conditions. A pair of decentralizing arms are mounted on the tool body with one arm disposed above and the other arm disposed below the sensor pad assembly and adapted for extension from the tool body in a direction opposite to the direction of extension of the sensor pad assembly for contacting the borehole wall and decentering the longitudinal axis of the tool body in the borehole in the direction of the extension of the sensor pad assembly. Force loading means disposed in the tool body cooperate with each of the pair of decentralizing arms for providing independent preselected force loading to each of the pair of arms for applying the preselected decentralizing loading force to the borehole wall. The force loading means may include individual linkage and variable spring systems for applying a predetermined loading force through the decentralizing arms to the borehole wall.

In accordance with further principles of the invention, a caliper arm is mounted on the tool body and longitudinally spaced above the sensor pad assembly and adapted for extension into contact with the borehole wall above the extended sensor pad assembly for calipering the rugosity of the borehole wall along the path of contact therewith by the sensor pad assembly. A spring system cooperates with the caliper arm for maintaining the arm in contact with the borehole wall under rugose conditions and to provide limited arcuate movement of the caliper arm in response to the rugosity of the borehole wall. Rugosity sensing means disposed within the tool body and cooperates with the caliper arm for sensing movement of the caliper arm in contact with the borehole wall and generates an electrical signal representative of the rugosity of the borehole wall surface. In addition, actuating means disposed within the tool body cooperates with the knuckle joint links of the linkage means for the sensor pad assembly, the linkage systems of the decentralizing arms and the caliper arm for deployment thereof.

BRIEF DESCRIPTION OF THE DRAWINGS

In order that the manner in which the above-recited principles and features of the invention are attained can be understood in detail, a more particular description of the invention may be had by reference to specific embodiments thereof which are illustrated in the accompanying drawings, which drawings form a part of this specification In the drawings:

FIG. 1 illustrates an embodiment of the present invention disposed in a typical oil or gas wellbore, FIG. 2 illustrates an embodiment of the carrier apparatus disposed in a borehole prior to actuation into contact with the borehole wall.

FIG. 3 illustrates an embodiment of the carrier apparatus as shown in FIG. 2 when it has been fully deployed for logging.

FIG. 13 is a horizontal cross-sectional view of the portion of the carrier apparatus as taken along lines 13—13 of FIG. 12.

FIG. 14 is a horizontal cross-sectional view of the portion of the carrier apparatus as taken along lines 14—14 of FIG. 12.

FIG. 15 is a partial vertical cross-sectional view of a portion of an actuating motor used in the invention.

FIG. 21 is a side view of one half section of a wireway knuckle joint link.

FIG. 22 is a horizontal cross-sectional view of the assembly of a typical wireway upper knuckle joint link.

DETAILED DESCRIPTION OF THE PREFERRED EMBODIMENTS

Figure 4:
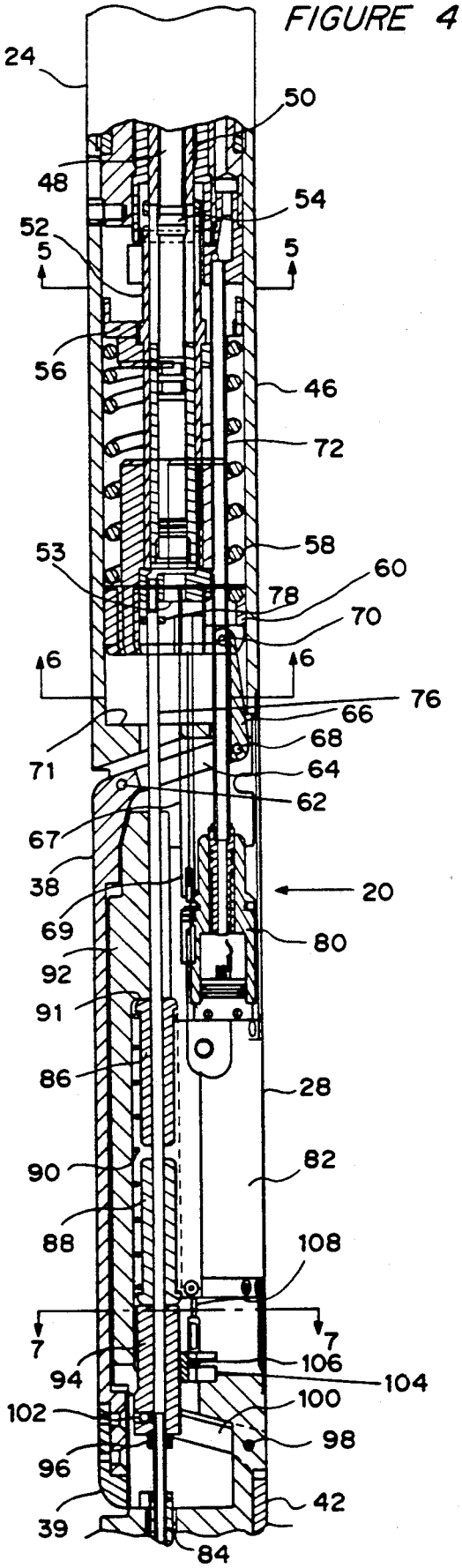
FIG. 4 is a detailed vertical cross-sectional view of the upper portion of the carrier apparatus including the upper decentralizing arm.
Figure 5:
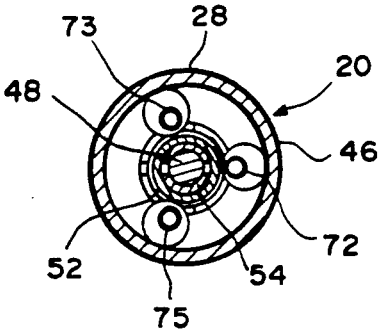
FIG. 5 is a horizontal cross-sectional view of the portion of the carrier apparatus as taken along lines 5—5 of FIG. 4.
Figure 6:
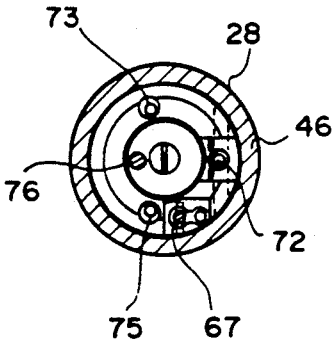
FIG. 6 is a horizontal cross-sectional view of the portion of the carrier apparatus as taken along lines 6—6 of FIG. 4.
Figure 7:
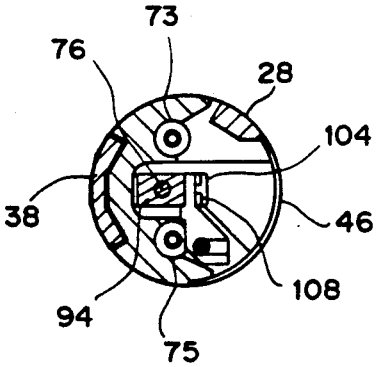
FIG. 7 is a horizontal cross-sectional view of the portion of the carrier apparatus as taken along lines 7—7 of FIG. 4.

Referring now to FIG. 1, a radioactive logging tool 10 is shown suspended by means of a conventional wireline cable 12 in an oil or gas borehole 14. The cable 12 is supported by a sheave assembly 16 and controlled by winch apparatus (not shown) mounted in truck 18. The sheave assembly 16 also provides depth information to determine the depth of the instrument 10 within the borehole.

The logging instrument 10 may comprise the logging instrument 20 disposed on the lower end of the tool string and a telemetry sub 26 disposed on the upper end of the tool string. In the present invention, the radioactive logging instrument 20 includes a lower motor section 22, an upper motor section 24 and a central section 28 including decentralizing arms and the radioactive sensor package for deployment into contact with the borehole wall. Data from the logging instrument section 20 is transmitted to the telemetry section 26 in a conventional manner for storage and/or transmission to the surface via the wireline cable 12 to conventional recording and display equipment (not shown) housed in truck 18. In operation, the tool string 10 is lowered to a preselected depth in borehole 14, the instrument sensing package and decentralizing arms are actuated and deployed into contact with the borehole wall and the logging instrument is raised at a predetermined rate through the borehole 14 to perform the logging operation.

FIGS. 2 and 3 show the radioactive logging instrument of FIG. 1 disposed in wellbore 14 in greater detail both before and after deployment of the sensor package and the decentralizing arms. In FIGS. 1 and 3, a portion of the tool string 10 is shown comprising the radioactive logging instrument 20 and the lower end of the telemetry sub 26. The instrument 20 includes an upper actuating motor section 24, a lower actuating motor section 22 and a central carrier section that carries the radioactive sensor package 30, the rugosity caliper arm 42 and the decentralizing arms 38 and 40. In FIG. 2, the radioactive sensor package 30, the rugosity caliper arm 42 and the decentralizing arms 38 and 40 are shown retracted within the body of the carrier section 28. In FIG. 3, the decentralizing arms 38 and 40 are shown deployed into contact with the borehole wall 14 for decentering the longitudinal axis of instrument 20 toward the opposite side of the borehole in the direction of deployment of the radioactive sensor pad 30. The sensor pad 30 is also shown deployed into contact with the borehole wall by means of linkage means or assemblies 32 and 34. A supporting link 36 interconnecting the carrier body 28 of the instrument 20 to the upper linkage 32 is provided to support the weight of the radioactive sensor pad 30 as will be hereinafter further explained.

The linkage assemblies 32 and 34 are independently linked between the carrier 28 and the opposite ends of the sensor pad 30 and each are spring loaded and independently adjustable for setting a preselected sensor package 30 force loading against the borehole wall as will hereinafter be further explained. In addition, each decentralizing arm 38 and 40 has its own independent linkage and spring system (not shown) and each is independently adjustable for setting the decentralizing force load output transmitted through the arms to the borehole wall as will be hereinafter described in greater detail.

Referring now to FIGS. 4–7, details of the instrument carrier apparatus will be explained in greater detail.

The upper portion of the central section 28 of radioactive logging instrument 20, including the lower end of the upper motor section 24 and the upper decentralizing arm 38 are shown in FIG. 4. The tool comprises an elongated instrument carrier body 46 having a generally cylindrical cross-section. A drive rod 48, connected to a drive motor (not shown) is adapted for limited longitudinal axial movement within the tool body 46 and supported within a bearing sleeve 50 the actuating drive rod 48 is connected to an actuating sleeve 52 by a pin 54. Concentrically mounted on the sleeve 52 is an annular spring engaging member 56. A compression spring 58 is disposed concentrically within the tool body 46 and around the actuating sleeve 52. An annular spring retaining member 60 is restrained by the other end of sleeve 52. Decentralizing arm 38 has a free end 39 and is mounted for limited pivotal arcuate movement around a transverse axial pin 62. The end 64 of the arm 38 is curved laterally to the main portion of arm 38 and is disposed within the body housing 46. A link 66 connects the end of the curved portion 64 of arm 38 to the spring retainer ring 60 by pins 68 and 70, respectively. A tube or conduit 72 is disposed longitudinally through the housing for providing a sealed conduit for accommodating electrical wires for power and data transmission. Other conduits 73 and 75 are shown in the cross-section of FIG. 5 but are not shown in FIG. 4 for simplifying the drawing. The downhole end of the tubing 72 is connected to a sealed electrical connector 80.

Attached to the lower side of the actuating sleeve 52 is another actuating rod 76 that is attached thereto by means of a threaded connection and retained in place by lock nut 78. The rod 76 extends downwardly and is connected to one end of a collet rod 84 that further projects downwardly through the tubing body 46. Concentrically disposed over the actuating rod 76 are a pair of spring retainer members 86 and 88 that retain between them a compression spring 90. The upper retainer number 86 is held in place by shoulder 90 disposed in support member 92. The lower retainer member 88 bears against a caliper travelling block 94 that is free to move concentrically on rod 76 but is retained by nut 96.

The rugosity caliper arm 42 is mounted for limited arcuate movement with respect to the body 46 by a transverse pin 98. The free end 43 of the caliper arm 42 lays in a slot in the surface of body member 46 (see FIG. 8). The other end 100 is disposed generally transversely to the arm 42 and extends into the housing 46. The end of the caliper arm portion 100 is pivotally linked to the travelling block 94 by a pin 102. A pad or block 104 is attached to the side of travelling block 94 and engages the end 106 of a projecting actuating rod 108 of a potentiometer assembly 82 mounted within the housing 46. A rod 67 is interconnected between the downhole face of spring retaining member 60 and a link 69 connected to a second actuating rod (not shown) lying behind connector 80, that is connected to a potentiometer in the potentiometer assembly 82. The function of the potentiometer assembly 82 will be hereinafter further explained.

Figure 8:
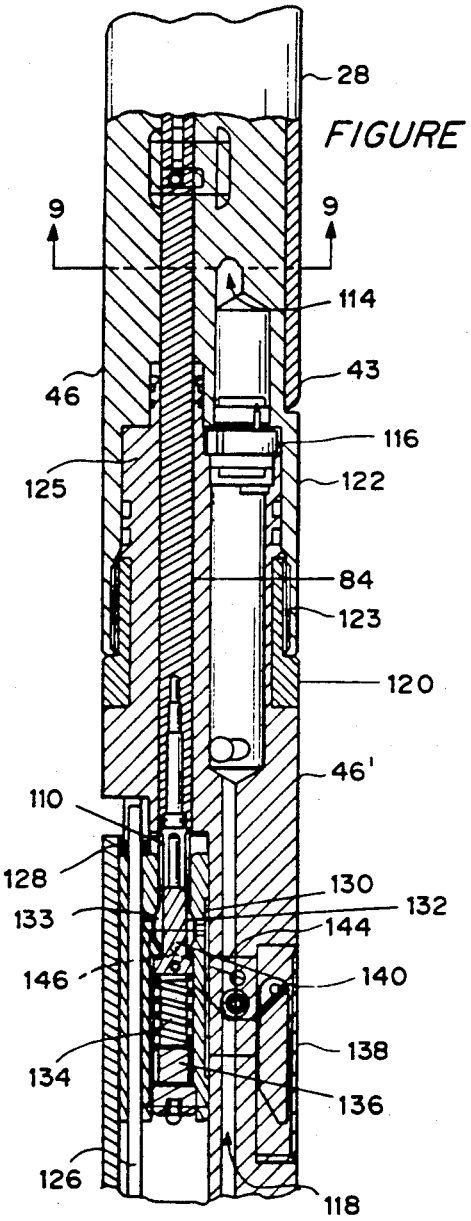
FIG. 8 is a detailed vertical cross-sectional view of the upper portion of the carrier apparatus just below the upper decentralizing arm.
Figure 9:
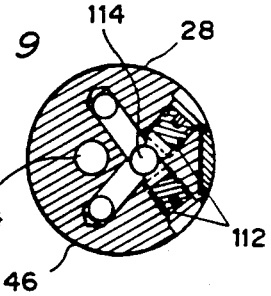
FIG. 9 is a horizontal cross-sectional view of the portion of the carrier apparatus as taken along lines 9—9 of FIG. 8.

Referring now to FIGS. 8 and 9, the next downhole portion of the instrument section 28 is shown including the body member 46. The body member includes a downhole facing female thread end 123 that receives the male end 125 of the lower body portion 46' and a threaded coupling sleeve 120. The sleeve 120 permits the threaded interconnection of the two instrument body members 46 and 46' and permits the separation of the tool 28 for transportation purposes. An aperture 114 is drilled in body member 46 and opens into a chamber carrying an electrical connector. Plugs 112 are shown in the cross-sectional view of FIG. 9 for closing access ports into the body member 46.

The collet rod 84 terminates in its downhole end in a multi-fingered collet member 110. A collet block 130 is disposed for longitudinal sliding movement within body member 46' and has a central bore therethrough including a collet detent 133 for accepting the end of the collet member 110 having a mating reciprocal configuration. Concentrically mounted within the collet block is a collet pin 132 and a collet spring cap 136 which is fitted in the end of block 130. A compression spring 134 is disposed between cap 136 and a shoulder of pin 132. Pin 132 may be axially moved toward the cap 136 against the force exerted by spring 134. A collet actuator handle 138 is disposed within the housing 46' and adapted for rotation about pin 140. The crank portion 144 of the actuating handle 138 has a finger end 146 that engages a pin in collet pin 132. By manipulating the handle 138, the collet pin may be manually displaced downwardly toward the cap 136, thus removing the pin from the interior of the collet member 110, thus permitting the collet rod 84 and the attached collet member 110 to be removed from the bore of the collet block 130, due to the deformation of the collet fingers and their disengagement from detent 133. This permits the separation of the instrument carrier 28 into the upper section 46 and lower section 46' by means of the threaded coupling sleeve 120.

Figure 10:
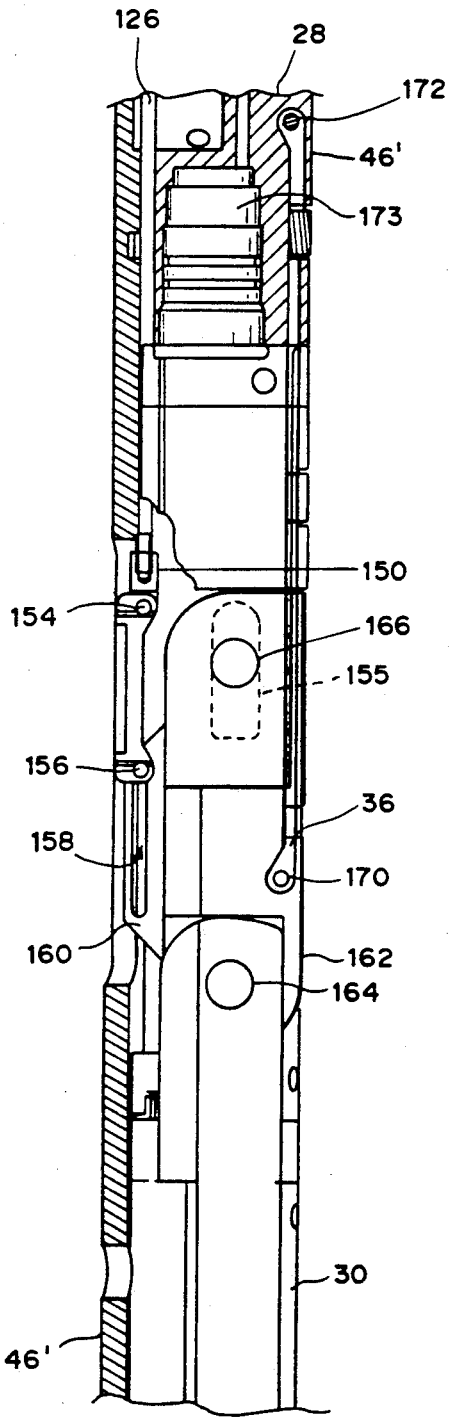
FIG. 10 is a detailed vertical cross-sectional view of the upper portion of the carrier apparatus including the upper sensor pad linkage system.

Referring now also to FIG. 10, a sensor pad rod 126 is longitudinally disposed through a bore in the collet block 130 and is attached thereto by means of a retaining nut arrangement 128 (FIG. 8). The downhole end of the rod 126 is threadably connected to a block 150. The block 150 is attached to one end of a link 152 by a pin 154 for permitting rotational motion therebetween. The other end of the link 152 is connected to the knuckle link assembly 162 by a pin 156 disposed through a slot 158 in a lower flange 160 of the knuckle joint. The knuckle joint 162 is rotatably attached to sensor pad 30 by means of a pin 164 and rotatably attached to the housing carrier 46' by pin 166 which is disposed in a slot 155 in housing 46' for also permitting limited longitudinal motion. The construction of the knuckle joint link assembly 162 will be hereinafter further explained in detail.

Figure 11:
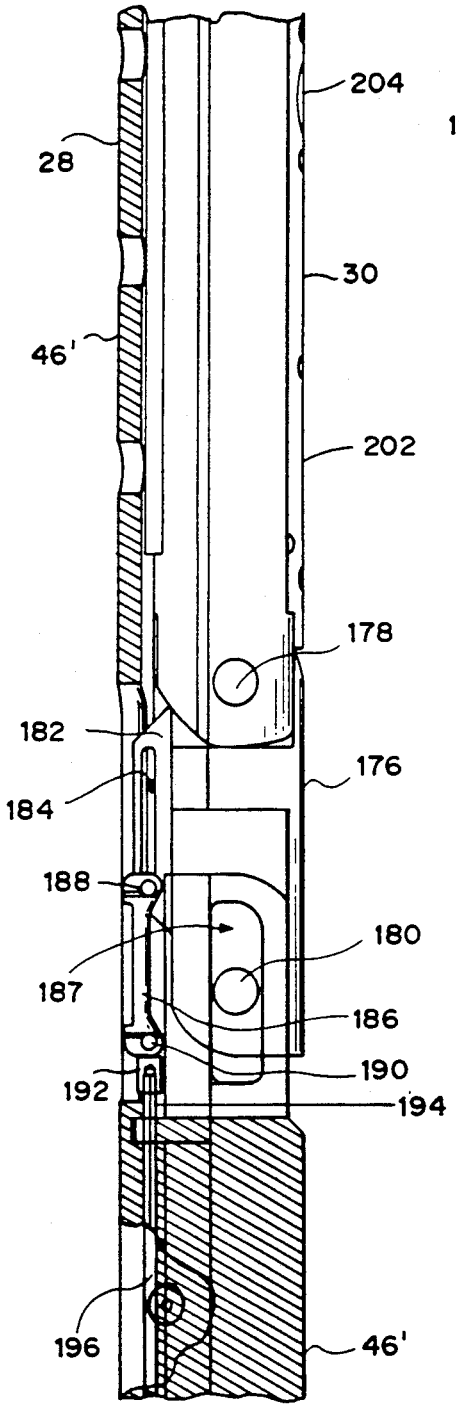
FIG. 11 is a detailed vertical cross-sectional view of the lower portion of the carrier apparatus including the lower sensor pad linkage system.
Figure 12:
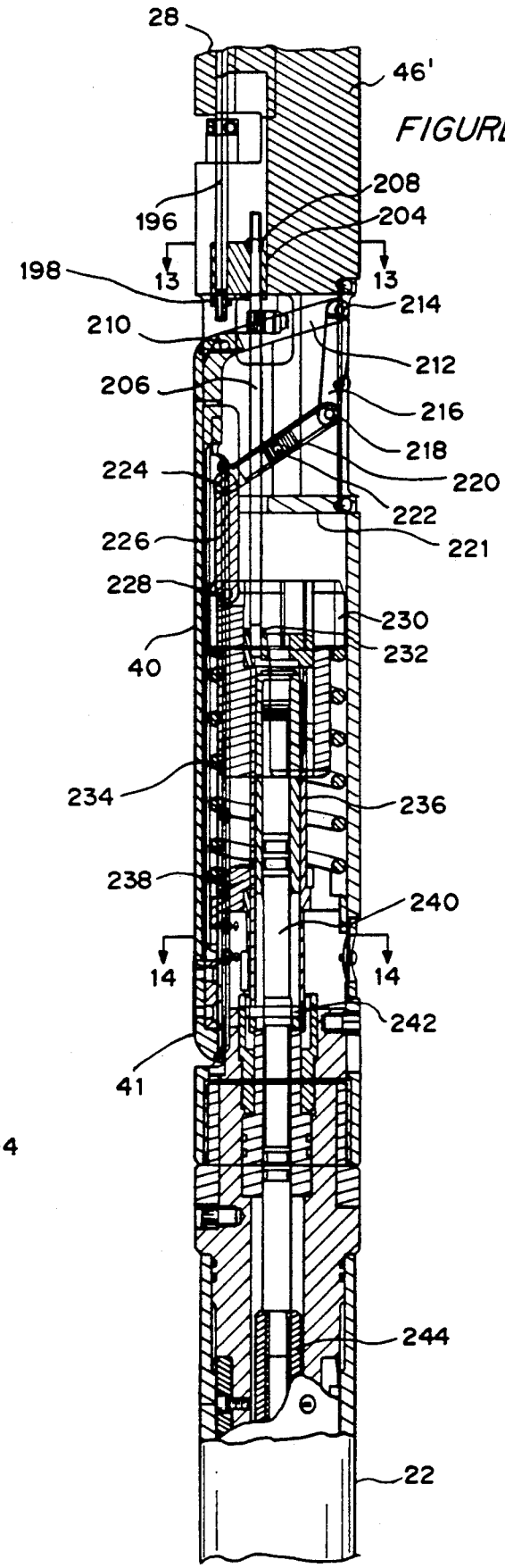
FIG. 12 is a detailed vertical cross-sectional view of the lower portion of the carrier apparatus below the sensor pad lower linkage and including the lower decentralizing arm.

FIGS. 11 and 12 show the lower end of the sensor pad assembly 30, showing "windows" for coupling the gamma ray source 202 and a detector 204 to the formation wall. The downhole end of the sensor pad 30 is rotatably connected to a knuckle joint link assembly 176 by a pin 178. The lower end of the knuckle link 176 is mounted for rotational motion with respect to carrier body member 46' by means of a transverse pin 180 which is disposed in a slot 187 in housing 46' for also permitting limited longitudinal motion. The lower side of the knuckle joint link 182 has a slot 184 therein, and one end of a link 186 is attached to the flange 182 by means of a pin 188. The other end of link 186 is rotatably connected to a connection block 192 by means of a pin 190. Threadably connected to the block 192 is one end of a rod 196 that is free to move longitudinally through a bore in body 46'. The other end of the rod 196 passes through a bore in a connection block 204 and retained by means of a retainer nut 198. The end of an actuator rod 206 also passes through the block 204, offset from rod 196, and is retained by a retainer nut 208. The other end of rod 206 is threadably connected to the upper end of the actuating sleeve 236. The spring retainer member 230 is restrained by the end of sleeve 236 fixed to the actuator rod 240 by the transverse pin 242. The downhole end of the rod 240 is connected to a motor actuating sleeve 244 disposed in the lower motor section 22. Concentrically mounted on sleeve 236 is an annular spring engaging member 238 and a compression spring disposed between the spring retainer member 230 and the engaging member 238.

The lower decentralizing arm 40 has a free end 41 and a generally transverse portion 212 that is disposed within the housing 46'. The arm 40 is mounted for arcuate movement about the transverse pin 210. The end of the arm transverse portion 212 is rotatably attached to one end of a link 216 by a pin 214. The other end of link 216 is rotatably attached to one end of a pivot link 220 by means of pin 218. The link 216 pivots about transverse pin 222 and has its lower end attached to connecting link 226 by means of a pin 224. The other end of link 226 is connected to the upper end of the spring retainer member 230. As also shown in cross-sectional views of FIGS. 13 and 14, electrical cable conduits 241 and 243 (not shown in FIG. 12 for simplicity) are disposed longitudinally through body member 46' for electrical power and control purposes.

FIG. 15 shows a portion of the lower actuating motor drive or actuating sleeve 244 that is threaded on the motor (not shown) drive shaft 246 disposed in the lower motor section 22. A support block 250 is attached to the housing of the motor section 22 for supporting the sleeve as it moves longitudinally in response to the rotation of drive shaft 246 projecting from the bearing assembly 248. As the electric motor (not shown) turns the drive shaft 246, the threaded interconnection with actuating sleeve 244 causes translational longitudinal motion to be imparted to the sleeve for actuating rod 240 (FIG. 12). The limit switches 252 and 254 are controlled by the end 256 of sleeve 244. The spacing between the limit switches 252 and 254 determines and limits the travel of sleeve 244 and the actuating rod 240. The operation of the upper motor section 24 is identical to the operation of the motor section 22 just described and will control the longitudinal motion of the actuating shaft 48 (FIG. 4).

Figures 16, 17, 18, 19, 20:
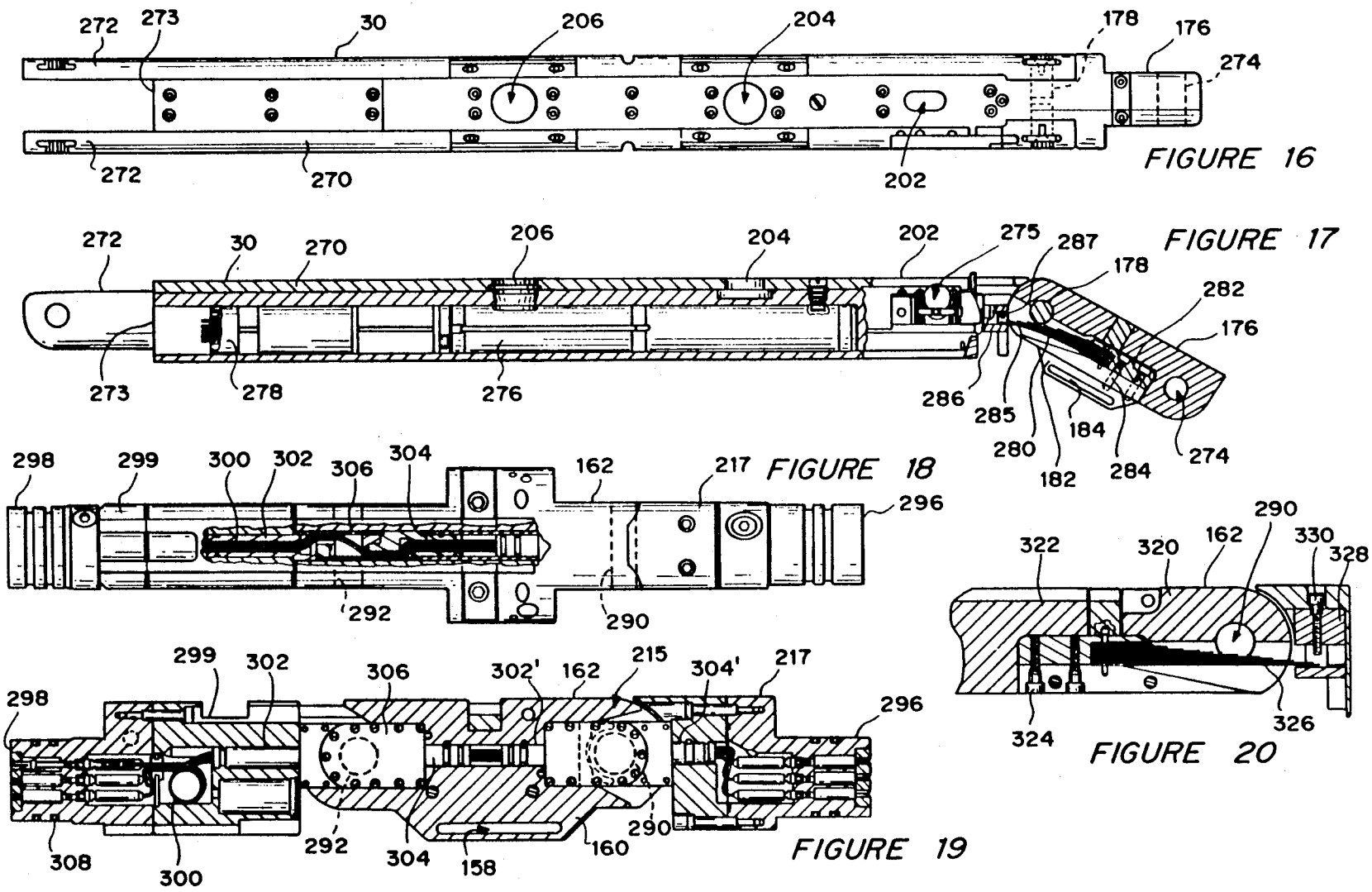
FIG. 16 is an upper plan view of the radioactive sensor pad assembly including the lower linkage.
FIG. 17 is a vertical cross-sectional view of the sensor pad assembly known as FIG. 16.
FIG. 18 is an upper plan view of the upper linkage assembly for the radioactive sensor pad assembly.
FIG. 19 is a vertical cross-sectional view of the upper linkage assembly shown in FIG. 18.
FIG. 20 is a detailed vertical cross-sectional view of the leaf spring assembly from the upper knuckle joint link.

Referring now to FIGS. 16–22, the construction of the knuckle link assemblies will be explained. The sensor pad assembly includes a generally elongated cylindrical housing 270 carrying a radioactive source assembly 275 and a detector package 276. The detector package is connected via appropriate wiring to a connector 278 disposed in the uphole end of the sensor pad housing. The source 275 and the detector package 276 communicate through the contact "windows" 202, 204 and 206 to the exterior of the sensor pad (where there are two detectors). The downhole end of the sensor pad assembly 30 has a downstream link joint 176 attached thereto by the mounting pin 178. The aperture 274 in the other end of the link 176 accommodate the mounting pin 180 transversely disposed in housing 46' (FIG. 11). The link 176 has disposed therein a leaf spring assembly 280 one end of which is mounted within the link 176 by a retainer block 282 fastened in place by screws 284. The free end 285 of the spring 280 held by a retainer member 286 attached to the sensor pad housing by a screw 287. The leaf spring assembly 280 normally tends to bras the link and sensor pad 30 outwardly or to an extended position as shown in FIG. 17. The loading force that the leaf spring 280 exerts outwardly on the sensor pad 30 can be varied by adjusting the screw 287 which moves the retainer member with respect to the sensor pad housing 270 and the spring free end 285.

The upper knuckle joint link assembly 162 is shown in FIGS. 18–22. The knuckle joint assembly 162 comprises an upstream connector block 299 having a male connector end 298 for insertion into the female connector 173 disposed in the carrier housing 46' (FIG. 10) and a female end for receiving the male tubing connector 302 of the wire-way knuckle joint link assembly 162. Seals 308 are disposed about the end of the connector 298 for sealing the electrical conduit passageway from borehole fluids. Electrical wires 300 are disposed internally of block 299 and designed to pass through the knuckle joint link assembly. As may be seen in greater detail in FIG. 22, the upper knuckle joint comprises a pair of pivot joints 316 and 310 having tubular wire conduit ends 302 and 304 respectively, that have complementary mating concentric annular portions 315 and 311. When the mating pivot joints are assembled, they will pivot about the center line axis shown by means of a pin 166 (FIG. 10). The passageway disposed through the mated pivot points will provide an opening through the pivot communicating from aperture 314 in end 302 to the aperture 312 in end 304 as shown by the representation of a portion of the wire bundle 300 threaded therethrough. This design permits the wire cable 300 to be able to traverse the knuckle joint assembly and still accommodate the pivoting joints and not place stress on the cable. Such a design avoids the use of a ring-type electrical connection at such a pivot point which are generally unreliable and prone to contact problems. The downhole pivot joint assembly shown generally at 215 is almost identical in construction to that of the upper pivot joint assembly described above, and no further details will be used to describe its basic construction and operation. The pivot joint assembly 215 has an uphole connector end 302' and a downhole connector 304' (similar to connectors 302 and 304 of the upper assembly). The downhole connector 304' is insertable into the female end of link block 217 for providing wiring communications to the electrical connector 296. Connector 296 is insertable in the uphole end 273 of the sensor pad assembly for mating with connector 278 for completing the electrical circuit through the sensor pad assembly 30.

The operation of the carrier apparatus for the radioactive well logging device 20 will now be described with reference to the drawings. Upon an electrical signal from the logging instrument operator located in truck 18, electrical power is simultaneously to be applied to the drive motors of motor sections 22 and 24. Although the operation and the deployment of the decentralizing arms 38 and 40, the sensor pad assembly 30 and the caliper arm 32 are actuated simultaneously, the description that follows will for simplicity describe the deployment sequence from uphole to downhole (from motor section 26 to motor section 22). Upon actuation of the drive motor in the upper motor section 24, the actuating shaft 48 is driven axially in a direction downhole thus driving the sleeve 52, the spring engaging member 56 and the spring retainer member 60 axially downhole until the member 60 engages the internal shoulder 71 of the carrier body 46. Upon engagement with the shoulder 71, the spring retainer member 60 stops, but the downhole end 53 of sleeve 52 continues axially in a downhole direction, thus allowing the spring engaging member 56 to compress spring 58 to apply a preselected loading force to the spring. The length of travel of the member 56 after the member 60 has engaged step 71 determines the force loading applied to the spring 58 and is determined and preset by the spacing between the microswitches monitoring the travel of the actuating sleeve (see FIG. 15 for parallel downhole motion section operation). The downhole movement of the spring retaining member 60 deploys the upper decentralizing arm 38 through link 66 acting on the inner crank end 64 of the arm 38. When the free end 39 of the arm 38 contacts the borehole wall, the preselected force loading of the compressed spring 58 will be constantly transmitted to the arm 38. The outward travel of arm 38 is translated to the caliper rod 67 by the movement of the spring retaining member 60. The rod 67, linked to the potentiometer assembly 82 by link connection 69, causes a potentiometer of assembly 82 to generate an electrical signal representative of the travel of the end 39 of arm 38 for determining borehole diameter. The actual diameter of borehole 14 can be determined from the data supplied by the calipering potentiometer assembly 82 measuring the travel of both arm 38 and the rugosity calipering arm 42.

In addition, downhole travel of the member 60 also drives the attached drive rod 76 downhole through the spring retainer members 86 and 88 and drives the block 94 downhole. The motion of block 94 rotates caliper arm 100 to deploy the caliper arm into contact with the wall of the wellbore. As the tip 43 of the caliper arm 42 traces a path up the borehole wall, the rugosity of the wall will cause the arm 42 to pivot about the pin 98 and cause longitudinal movement of the connected caliper block 94. The translational movement of block 94 will also move the attached block 104 and move the potentiometer actuating member 108 for causing the potentiometer 82 to generate an electrical signal representative of the caliper arm movement for transmission uphole to the instrument track 18. In this way, the rugosity of the borehole way along the path to be traversed by the sensor pad assembly 30 can be recorded and monitored. The downhole motion of rod 76 is transmitted to the collet rod 84, thus displacing the collet block 130 downhole. As the block 130 moves downhole, the holding tension in rod 126 is released and the preselected leaf spring loading force in the upper knuckle joint link assembly 162 pulls rod 126 downwardly displacing link 152 and permitting the knuckle joint to fully extend and deploy the sensor pad assembly into contact with the borehole wall. As the sensor pad assembly 30 is deployed, the weight loading arm 36 pivots about pieces 170 and 172 to an extended position. Arm 36 is designed to support the weight of the sensor pad assembly 30 in order that the knuckle joint assembly 162 does not have to support the weight and any friction forces transmitted to the pad 30 by the borehole wall as the sensor pad upwardly traverses the borehole wall.

Simultaneously with the deployment operation above described, the electric motor in the lower motor section 22 is actuated, thus driving the actuating sleeve 244 uphole as described with reference to FIGS. 12 and 15. The uphole movement of sleeve 244 drives the actuating rod axially uphole which in term drives sleeve 236, spring engaging member 238, spring 234 and the spring retaining member 230 uphole until member 230 contacts shoulder 221. After member engages shoulder 221 the sleeve 236 continues its uphole travel and causes the spring engaging member 236 to compress spring 234 to a preselected loading force related to the over-travel of member 238 after member 230 has contacted shoulder 221. As hereinabove described, the loading force may be selected by adjusting the spacing of the microswitches in the motor section as described above in relation to FIG. 15.

The uphole movement of the retainer member 230 drives link 226 uphole and pivots link 220 to drive link 216 in a downhole direction, thus deploying the lower decentralizing arm 40 into contact with the borehole wall. The selected spring loading of spring 234 is thus transmitted to the arm 40 and the arm tip 41 and to the borehole wall.

The uphole movement of the sleeve 236 drives rod 206 and releases tension on the rod 196. Release of the tension on rod 196 permits the leaf spring of link assembly 176 to force the sensor pad assembly 30 outwardly to a deployed position. The preselected loading force of the leaf spring of link assembly 176 is transmitted through the sensor pad 30 to the borehole wall when the tool is traversing the borehole 14 during logging operations. To retract the decentralizing arms 38 and 40, the caliper arm 42 and the sensor pad assembly, the motors in the motor sections 22 and 26 are reversed, thus reversing the operation above described. The upper and lower pull rods 126 and 196, respectively are pulled against the spring loading of the respective link joint assemblies 162 and 176, respectively, to retract the sensor pad assembly 30 into the housing 46'. The loading force applied to the decentralizing arms 38 and 40 now acts against the spring engaging members 60 and 230, respectively, to assist in applying the necessary retracting forces to rods 126 and 196 to overcome the loading force of the leaf springs and retract the sensor pad 30. In addition, the spring loading of springs 58 and 234 buffers the initial retraction forces applied to the actuating sleeves and the motor drive shafts.

Numerous variations and modifications may be made in the structure herein described without departing from the present invention. Accordingly, it should be clearly understood that the forms of the invention herein described and shown in the figures of the accompanying drawings are illustrative only and are not intended to limit the scope of the invention.

What is claimed is:

1. A carrier apparatus for a radioactive well logging instrument, comprising:

an elongated sensor pad assembly carrying a radioactive source and at least one detector, an elongated generally cylindrical tool body adapted for wireline suspension and movement within a well borehole and having an open cavity portion thereof adapted for accepting said elongated sensor pad assembly therein in a retracted position, linkage means mounted on said tool body and engaging opposite ends of said elongated sensor pad assembly for laterally extending said pad assembly from said tool body into contact with the borehole wall, said linkage means further permitting articulation of said pad assembly with regard to the tool body axis for maintaining said sensor pad assembly in contact with the borehole wall under rugrose conditions, linkage force loading means cooperating with said tool body and linkage means for providing independent preselected force loading to each end of said pad assembly for maintaining substantially constant pad assembly pressure in contact with the borehole wall during articulation of said sensor pad assembly with regard to said tool body, a pair of decentralizing arms mounted on said tool body with one arm disposed above and the other arm disposed below said sensor pad assembly and adapted for extension from said tool body in a direction opposite to the direction of extension of said sensor pad assembly for contacting the borehole wall and decentering the longitudinal axis of the tool body in the borehole in the direction of extension of said sensor pad assembly, force loading means disposed in the tool body and cooperating with each of said pair of decentralizing arms for providing independent preselected force loading to each of said pair of arms for applying a predetermined decentralizing force load to the borehole wall, and actuating means disposed in said tool body for cooperating with said linkage means, said pair of decentralizing arms and said force loading means for deploying said sensor pad assembly and said pair of decentralizing arms and applying said loading force means to said pair of decentralizing arms.

2. The carrier apparatus as described in claim 1, further including:

a caliper arm mounted on said tool body and longitudinally spaced above said sensor pad assembly and adapted for extension into contact with the borehole wall above said extended sensor pad assembly for calipering the rugosity of the borehole wall along the intended path of contact therewith by the sensor pad assembly, and rugosity sensing means disposed in the tool body and cooperating with said caliper arm for sensing movement of said caliper arm in contact with the borehole wall and generating an electrical signal representative of the rugosity thereof.

3. The carrier apparatus as described in claim 2 further comprising borehole size sensing means disposed in the tool body and cooperating with one of said pair of decentralizing arms for sensing total extension thereof into contact with the borehole wall and generating an electrical signal representative thereof.

* * * * *